US006824717B2

(12) United States Patent
Schäfer

(10) Patent No.: US 6,824,717 B2
(45) Date of Patent: Nov. 30, 2004

(54) METHOD FOR MELT SPINNING FILAMENT YARNS

(75) Inventor: Klaus Schäfer, Remscheid (DE)

(73) Assignee: Saurer GmbH & Co. KG, Mönchengladbach (DE)

( * ) Notice: Subject to any disclaimer, the term of this patent is extended or adjusted under 35 U.S.C. 154(b) by 321 days.

(21) Appl. No.: 10/092,110

(22) Filed: Mar. 6, 2002

(65) Prior Publication Data

US 2002/0121724 A1 Sep. 5, 2002

Related U.S. Application Data

(63) Continuation of application No. PCT/EP00/08416, filed on Aug. 29, 2000.

(30) Foreign Application Priority Data

Sep. 7, 1999 (DE) ..... 199 42 518

(51) Int. Cl.[7] ..... D01D 5/092; D01D 5/26; D02G 3/02

(52) U.S. Cl. ..... 264/101; 264/103; 264/143; 264/211.14; 264/211.15

(58) Field of Search ..... 264/101, 103, 264/143, 210.8, 211.12, 211.14, 211.15, 211.17, 237

(56) References Cited

U.S. PATENT DOCUMENTS 5,178,814 A 1/1993 Lemond
5,976,431 A 11/1999 Mears
6,103,158 A * 8/2000 Schafer et al. ..... 264/103
6,551,545 B1 * 4/2003 Hutter et al. ..... 264/555
2001/0015508 A1 * 8/2001 Schafer et al. ..... 264/101

FOREIGN PATENT DOCUMENTS

| | | |
|---|---|---|
| DE | 3503818 C1 | 4/1986 |
| EP | 0536497 B1 | 1/1995 |
| WO | WO 95/15409 A1 | 6/1995 |
| WO | WO 99/67450 A1 | 12/1999 |
| WO | WO 00/05439 A1 | 2/2000 |

* cited by examiner

*Primary Examiner*—Leo B. Tentoni
(74) *Attorney, Agent, or Firm*—Alston & Bird LLP

(57) ABSTRACT

A method of melt spinning a group of multifilament yarns (1) from a polymer melt, wherein each group of yarns (10) is formed from a plurality of filaments (4) that are extruded through a nozzle bore (3) and withdrawn by a withdrawal means by the action of a withdrawal tension. In accordance with the invention, each group of yarns (10) is cooled in a precooling zone (5) and in an aftercooling zone (6) downstream thereof. The cooling in the precooling zone (5) and in the aftercooling zone (6) is adjusted such that the group of yarns (10) is cooled within the aftercooling zone (6) by the action of a coolant flow directed into the path of the yarn, so that the filaments (4) of the group of yarns (10) solidify in a solidification range within the aftercooling zone (6).

15 Claims, 2 Drawing Sheets

METHOD FOR MELT SPINNING FILAMENT YARNS

CROSS-REFERENCE TO RELATED APPLICATION

This is a continuation of international application Ser. No. PCT/EP00/08416, filed Aug. 29, 2000, and designating the U.S.

BACKGROUND OF THE INVENTION

The invention relates to a method of melt spinning a group of multifilament yarns from a polymer melt.

For producing a synthetic spun-bonded nonwoven or for making a synthetic tow for producing staple fibers, it is necessary to spin a group of yarns from a polymer melt. Each of the yarns is formed from a plurality of filaments, which are extruded through nozzle bores. In this process, the group of yarns is withdrawn from the spinning zone by a withdrawal means. After the filaments of the group of yarns are emerged from the nozzle bores, the group of yarns undergoes a cooling in a cooling zone until the filaments are solidified.

In the production of a spun-bonded nonwoven, it is preferred to use air flows, as are disclosed, for example, in DE 35 03 818. In so doing, a coolant is directed substantially radially toward the group of yarns in a cooling shaft downstream of the nozzle bores. Directly downstream of the cooling shaft, a draw shaft is formed. The draw shaft has a configuration in the nature of a venturi nozzle, for generating an accelerated air flow for drawing the group of yarns. To this end, the draw shaft connects to a source of vacuum. In this process, the group of yarns is intensively cooled, so that the withdrawal force that is generated by the drawing does not lead to a tearing of the filaments.

In the case wherein the yarns are spun from an annulary arranged row of nozzle bores, the cooling of the group of yarns occurs likewise by a radially directed coolant flow, as is disclosed, for example, in EP 0 536 497. In this process, the group of filaments is cooled immediately after emerging from the nozzle bores by a coolant flow that is radially directed from the inside outward.

In the known method, the group of yarns undergoes an intensive cooling within the cooling zone. With that, the filaments of the group of yarns receive a crystalline preorientation, which determines the subsequent drawing and, thus, the physical properties of the group of yarns. An increase in the production speed in the known method is thus bound to lead to changed physical properties or to filament breaks in the case of an inadequate cooling.

It is therefore an object of the invention to further develop a method of the initially described kind such that it is possible to spin a group of yarns at higher production speeds with unvarying satisfactory physical properties.

SUMMARY OF THE INVENTION

The above and other objects and advantages of the invention are achieved by a method of the described type and which recognizes that the solidification of the filaments in the group of yarns is determined upon their emergence from the nozzle bores to their solidification by two mutually influencing effects. It is known that during the cooling of a polymer melt, same solidifies upon reaching a certain temperature. This process is solely dependent on the temperature, and is here named thermal crystallization. In the melt spinning of a group of yarns, the group is withdrawn from the spinneret. In this process, withdrawal forces act upon the filaments of the group of yarns, which cause a tension induced crystallization in the filaments. Thus, during the melt spinning of a group of yarns, thermal crystallization and tension induced crystallization occur in a superposed manner, and lead together to the solidification of the filaments.

The invention now provides a method, wherein the filaments of the group of yarns are cooled such that it is possible to influence both effects for achieving higher production speeds with unvarying satisfactory physical properties. To this end, the filaments of the group of yarns are initially precooled in the cooling zone, which is here named precooling zone, without a solidification of the polymer melt. Subsequently, the group of yarns is directly advanced into a second cooling zone, which is arranged downstream of the precooling zone and upstream of a withdrawal means, and named hereafter aftercooling zone.

Within the aftercooling zone, the filaments of the group of yarns are further cooled until their solidification by the action of a coolant flow, which is directed into the path of the yarn. This coolant flow has a predetermined flow velocity for influencing the yarn friction. As a result, it is possible to influence the withdrawal tension acting upon the filaments in such a manner that the tension induced crystallization occurs with a delay. Since the filaments of the group of yarns are solidified in the precooling zone substantially only in the external zones, the filaments are unable to take up any noteworthy withdrawal tensions. With that, no significant, tension induced crystallization occurs in the precooling zone, but exclusively a thermally caused crystallization. In this process, the group of yarns may be spun from the nozzle bores of a plurality of spinnerets or one spinneret in a linear line arrangement or in a circular line arrangement.

In a particularly advantageous variant of the method, the coolant flow is accelerated to the predetermined flow velocity in an acceleration zone within the aftercooling zone for purposes of influencing the yarn friction. In this process, the acceleration zone is formed preferably directly upstream of the solidification range of the filaments of the group of yarns. With that, it is possible to influence and control the aftercooling in the aftercooling zone independently of the precooling in the precooling zone. On the other hand, it is ensured that the accelerated coolant flow engages the filaments of the group of yarns in a phase, in which the filaments tolerate an externally engaging air friction, without breaking.

For influencing the withdrawal forces acting upon the group of yarns, a particularly advantageous variant of the method provides that the velocity of the coolant flow upstream of the solidification range is at least equal to or somewhat greater than the advancing speed of the filaments. The flow velocity of the coolant flow differs from the advancing speed of the filaments preferably by a factor 0.3 to 2.

The especially advantageous variant of the method is suited in particular for producing yarns of low, medium, or high deniers at a higher production speed and with uniform physical properties. In so doing, the influencing of the tension induced crystallization is performed under substantially unvarying conditions. The precooling of the filaments in the group of yarns after emerging from the nozzle bores, is adjustable in its cooling effect within the cooling zone such that it is possible to keep the position of the solidification range of the filaments in the group of yarns within the aftercooling zone in a predetermined desired range. Thus, the solidification of the filaments of the group of yarns occurs essentially always in the same place, so as to ensure a uniform treatment of the filaments for influencing the tension induced crystallization.

To influence thermal crystallization, the cooling effects that are caused by the coolant in the precooling zone, should be made variable. In this connection, however, it is necessary that the filaments of the group of yarns already exhibit a certain stability in particular in their outer surface layers before entering the aftercooling zone, so as to withstand the coolant flow in the aftercooling zone without damage.

A particularly advantageous variant for controlling the cooling is given by a further development of the invention, wherein the coolant is tempered before entering the precooling zone. In this instance, the coolant may be heated in its temperature to a value preferably in the range from 20° C. to 300° C. before entering the precooling zone. To spin, for example, a group of yarns with relatively low deniers, the coolant is preheated to a high temperature, for example, by a heating device. This influences thermal crystallization, which starts directly after the emergence from the nozzle bores, in such a manner that the filaments of the group of yarns are not solidified before entering the aftercooling zone. With that, an advantageous tension treatment is possible by a coolant flow, which is directed parallel to the group of yarns, and which leads to the solidification of the filaments in the group of yarns in the desired range of the aftercooling zone. In the case that a group of yarns with a high filament denier is to be spun, the coolant is adjusted to a lower temperature in the precooling zone, so that thermal crystallization is developed before the entry into the aftercooling zone to such an extent that the filaments of the group of yarns exhibit adequate stability when being engaged by the coolant flow.

For adjusting the cooling in the precooling zone, it is suggested according to another advantageous further development of the invention, that the volume flow of the coolant be varied. To this end, one may use, for example, a blower, which permits controlling the volume flow that is blown into the precooling zone.

The method of the present invention is independent of whether the coolant flow is generated in the aftercooling zone by a suction effect or by a blowing effect. The variant of the method, wherein a suction flow prevails in the aftercooling zone, has the advantage that thermal crystallization in the precooling zone and tension induced crystallization in the aftercooling zone can be influenced essentially independently of each other.

For generating a coolant flow by a blowing action, it is possible to blow the coolant into the precooling zone, and to direct it accordingly into the tension zone, or to blow a coolant that is supplied downstream of the precooling zone, directly into the aftercooling zone.

To obtain in particular in the case of a group of yarns with high filament deniers, an adequate cooling in the aftercooling zone, a variant of the method will be especially advantageous, wherein the coolant flow is generated from the coolant leaving the precooling zone and a coolant that is supplied directly upstream of the inlet to the aftercooling zone. The additionally supplied coolant allows to accomplish that in addition thereto the tension induced crystallization is likewise adjustable within wide ranges, thus permitting a further optimization of the physical properties.

The precooling of the filaments in the precooling zone can likewise occur by an air flow that is blown into the precooling zone, or by an air flow that is sucked into the precooling zone.

Based on its flexibility, the method of the present invention is suitable for melt spinning a group of yarns, which is laid to a spun-bonded nonwoven after the solidification of the filaments. In this process, the group of yarns is withdrawn in a linear line arrangement from the nozzle bores and deposited on a screen belt. Preferably, withdrawal nozzles are used as withdrawal means.

However, the method is also very well suited for combining a group of yarns after solidification of the filaments to a tow, which is deposited in a can for the production of staple fibers. In this process, the group of yarns is spun in a circular line arrangement, preferably from an annular nozzle, and advanced through the precooling and the aftercooling zone. After leaving the aftercooling zone, the group of yarns is combined to the tow. However, the tow could also be cut or torn directly to staple fibers in a subsequent process step, so as to be pressed thereafter to a bale.

Nonetheless, after the solidification of the filaments, it is also possible to divide the group of yarns into a plurality of individual yarns, which are wound to packages.

The group of yarns may be spun from a polymer melt on the basis of polyester, polyamide, or polypropylene.

BRIEF DESCRIPTION OF THE DRAWINGS

Referring now to the attached drawings, advantageous effects of the method according to the invention are described in greater detail with reference to embodiments of apparatus. In the drawing.

DETAILED DESCRIPTION OF THE PREFERRED EMBODIMENTS

Figure 1:
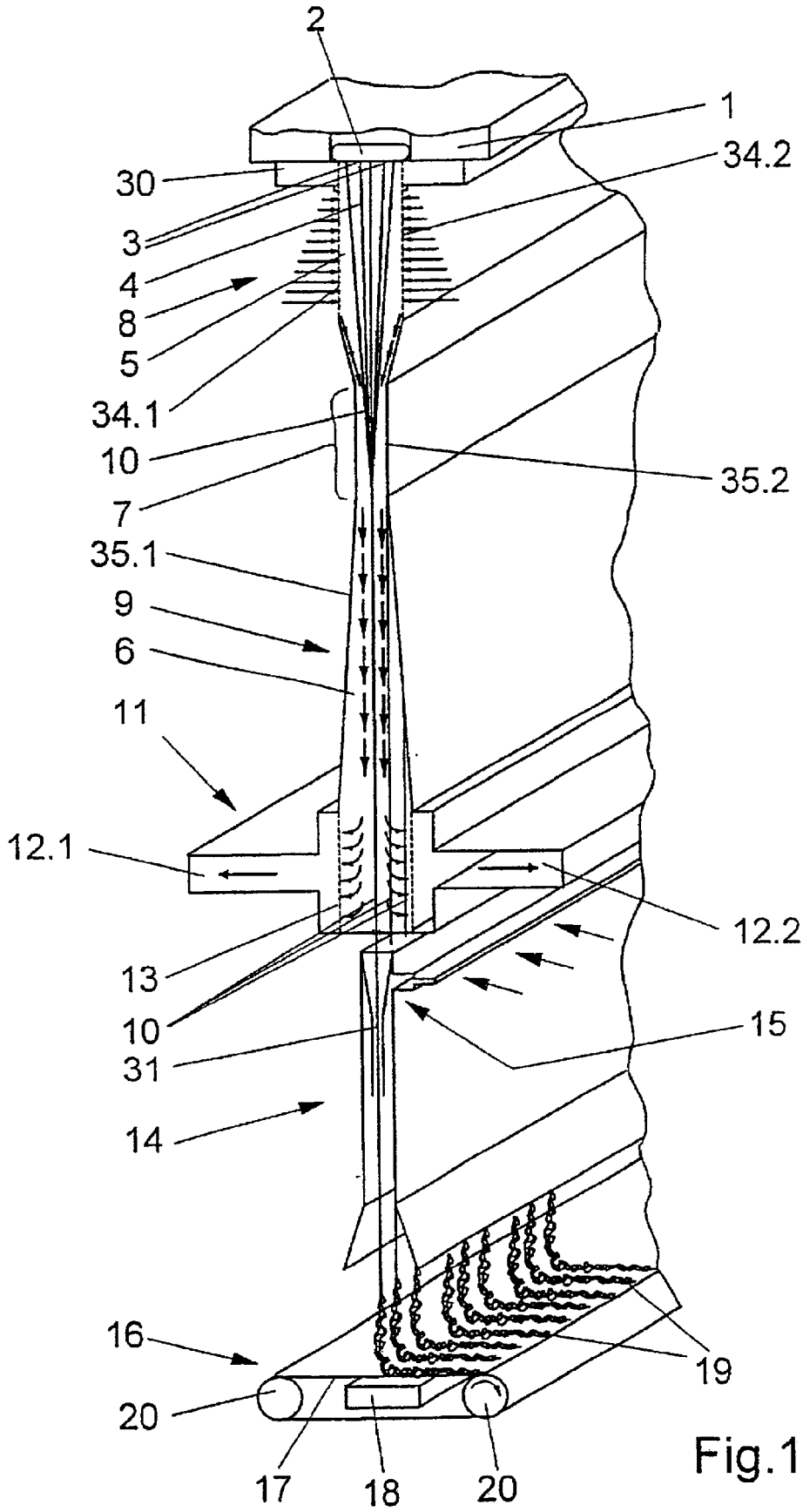
FIG. 1 is a schematic view of an apparatus for carrying out the method of the present invention for producing a spun-bonded nonwoven.

FIG. 1 illustrates a first embodiment of an apparatus for carrying out the method of producing a spun-bonded nonwoven. The apparatus comprises a heated spin head 1, which connects to a melt supply line (not shown). The underside of spin head 1 mounts a plurality of spinnerets 2, which are linearly arranged in a threadline. On their underside, the spinnerets 2 include a plurality of nozzle bores 3. Downstream of spin head 1, a precooling shaft 8 extends, which forms a precooling zone 5, through which a group of yarns 10 advances. On each of its opposite longitudinal sides, the precooling shaft 8 includes a gas-permeable side wall 34, through which a coolant, preferably cooling air is introduced into precooling zone 5. At the side ends of spin head 1, the precooling shaft 8 is closed by transverse walls.

Downstream of precooling shaft 8 is an aftercooling shaft 9. In aftercooling shaft 9, an aftercooling zone 6 is formed, through which the group of yarns is likewise advanced. In the present embodiment, the precooling shaft 8 and aftercooling shaft 9 extend in one plane, so that the group of yarns advances without deflection through precooling zone 5 and aftercooling zone 6. The underside of aftercooling shaft 9 connects to a suction device 11. On two sides, the suction device 11 is provided with a suction duct 12.1 and 12.2, respectively. These suction ducts connect to at least one source of vacuum (not shown).

In the longitudinal direction of aftercooling shaft 9, side walls 35.1 and 35.2 are shaped relative to each other in such a manner that an acceleration zone 7 results with a narrowest spacing between side walls 35.1 and 35.2. Upstream and downstream of acceleration zone 7, the side walls 35.1 and 35.2 of aftercooling shaft 9 are arranged with a greater spacing between each other, preferably with a continuously enlarging spacing. At the side ends of spin head 1, the aftercooling shaft 9 is closed by transverse walls.

In the threadline downstream of the cooling device, a withdrawal means 14 is provided for withdrawing the group of filaments 10 from the spinning zone. In the present embodiment, the withdrawal means 14 is formed by a withdrawal nozzle 31. On the inlet side of the group of yarns, the withdrawal nozzle 31 includes an injector 15, which connects to a compressed air supply. Downstream of the withdrawal nozzle, a device 16 for depositing nonwovens extends. The device 16 for depositing nonwovens consists of a screen belt 17, which is guided over rolls 20. On screen belt 17, the group of yarns 10 is laid in the form of a spun-bonded nonwoven 19. Below screen belt 17, a suction device 18 is arranged, which takes in the air flow exiting from withdrawal nozzle 31.

In the apparatus shown in FIG. 1, a thermoplastic material is melted to a polymer melt and supplied to spin head 1. A plurality of filaments 4 is extruded to a group of yarns 10 through a plurality of nozzle bores 3 of spinnerets 2. The group of yarns formed from the filaments is withdrawn by withdrawal means 14. In so doing, the group of yarns advances at an increasing speed through precooling zone 5 within precooling shaft 8. Subsequently, the group of yarns enters aftercooling shaft 9 and advances through aftercooling zone 6. In the aftercooling shaft 9, a vacuum is generated in aftercooling zone 6 by the action of a vacuum generator. In the precooling zone 5, the vacuum and a self-suction effect that is produced by the movement of the group of yarns, causes an air flow to be taken from the outside into the precooling zone 5. The side walls 34.1 and 34.2 of the precooling zone are made gas-permeable. The air flow leads to a precooling of the filaments 4 in the group of yarns 10. By the movement of the group of yarns 10 and by the action of the vacuum in aftercooling shaft 9, the air flow is directed into aftercooling shaft 9. In this process, a coolant flow develops in acceleration zone 7, which flows in the advancing direction of the group of yarns 10.

As a result of an adjustment between the vacuum and the spacing of the side walls in aftercooling shaft 9, the air flow is accelerated to a velocity, which is at least equal to or greater than the filament speed. Consequently, the group of yarns 10 is continuously cooled, until the filaments 4 of the group of yarns 10 are completely solidified. The solidification range of filaments 4 is adjusted by the air control such that the filaments solidify downstream or in the lower region of acceleration zone 7. After its cooling, the group of yarns is deposited by withdrawal nozzle 31 as a spun-bonded nonwoven 19 on screen belt 17. In this process, filament speeds are reached from 6,000 to 10,000 m/min, preferably 6,000 to 8,000 m/min. The group of yarns may be composed of filaments with an individual denier of 0.3 to 10 dpf, preferably 0.5 to 5 dpf. The coolant flow generated in the acceleration zone is accelerated in comparison with the filament speed to a flow velocity of 0.3 to 2 times the filament speed.

The apparatus illustrated in FIG. 1 for carrying out the method according to the invention is exemplary. In the illustrated apparatus, a heating device 30 is provided between precooling shaft 8 and spin head 1 for purposes of being able to adjust a delayed thermal crystallization. It is likewise possible to blow the cooling air into precooling shaft 8. An important concept of the invention is that solidification of the filaments in the group of yarns occurs only in the aftercooling zone for purposes of achieving a positive influencing of the physical properties at increased production speeds.

Figure 2:
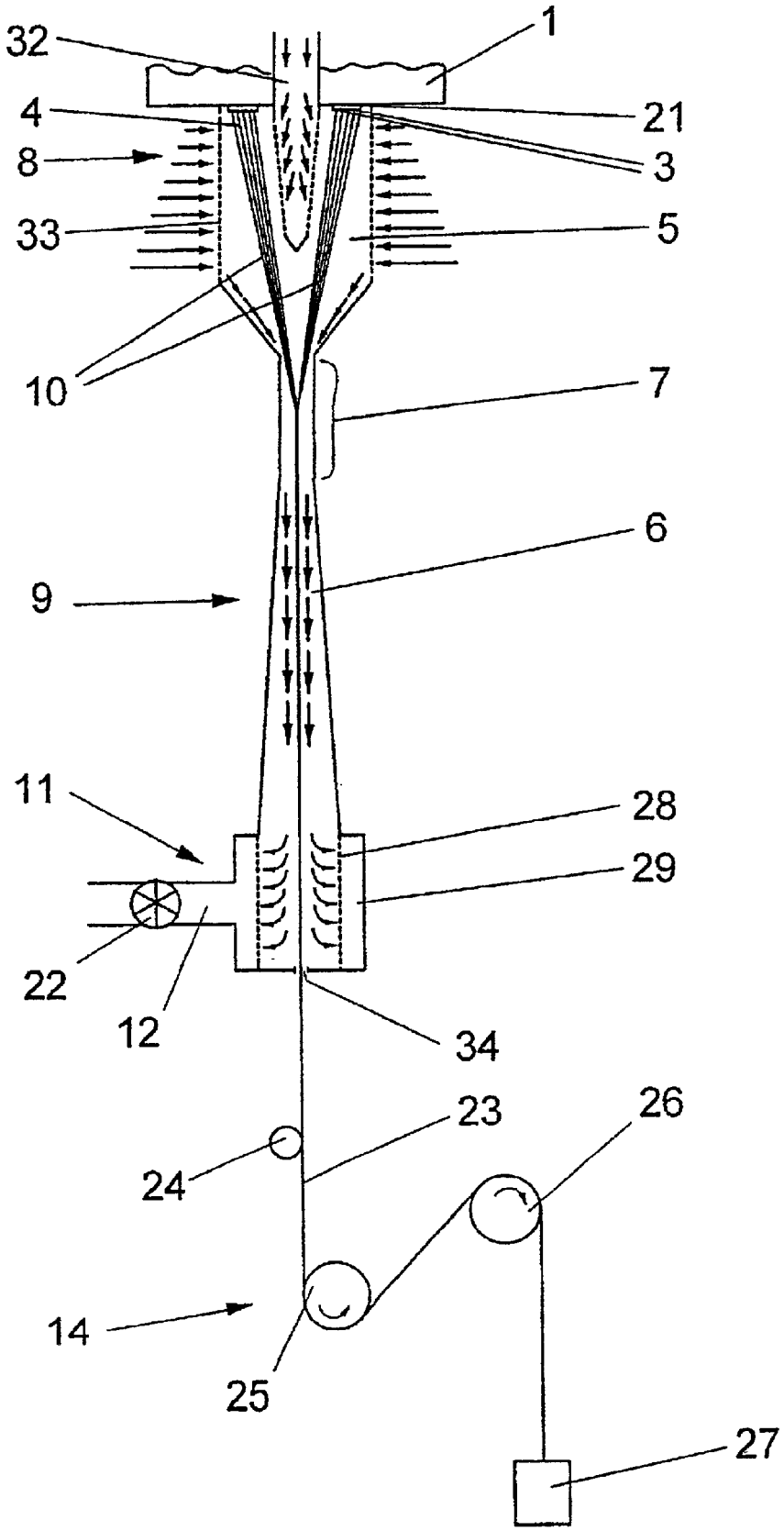
FIG. 2 is a schematic view of a further embodiment of an apparatus for carrying out the method for producing a tow.

FIG. 2 illustrates a further embodiment of an apparatus for carrying out the method, which is used for producing from the group of yarns a tow for the production of staple fibers. The apparatus comprises a spin head 1, which connects to a melt supply line (not shown). The underside of spin head 1 mounts an annular spinneret 21. The annular spinneret 2 includes a plurality of nozzle bores 3, which are arranged in the shape of a ring. Downstream of spin head 1 is a precooling shaft 8. The precooling shaft 8 is constructed with a gas-permeable wall 33, which is arranged in surrounding relationship with annular spinneret 21. The precooling shaft 8 forms a precooling zone 5 directly downstream of annular spinneret 21. Inside precooling zone 5, an air flow means 32 extends in the shape of a lancet from the underside of spin head 1 in centric relationship with annular spinneret 21 into precooling zone 5. The air flow means 32 causes a coolant to be radially directed from the inside outward into precooling zone 5.

Downstream of precooling shaft 8, an aftercooling shaft 9 extends along the threadline. The aftercooling shaft 9 is made preferably tubular, with an acceleration zone 7 with a narrowest cross section being formed in aftercooling shaft 9 between the inlet and the outlet end. On both sides of acceleration zone 7, the aftercooling shaft 9 is constructed with a preferably continuously enlarging flow cross section. The aftercooling shaft 9 forms an aftercooling zone 6. Downstream of aftercooling shaft 9 a suction device is provided, which generates a vacuum in the aftercooling zone. To this end, the suction device 11 includes a source of vacuum 22, which connects via a suction duct 12 to an outlet chamber 29. On its one side, the outlet chamber 29 connects to aftercooling shaft 9. On its opposite side, the outlet chamber 29 includes an outlet 34. Inside outlet chamber 29, a screen cylinder 28 is arranged in coaxial relationship with aftercooling shaft 9.

In the direction of the advancing yarn, the cooling device is followed by a withdrawal means 14. The withdrawal means 14 is formed by a plurality of godets 25 and 26. Between godet 25 and the cooling device, a roll 24 is provided for combining the group of yarns to a tow 23. Arranged downstream of withdrawal means 14 is a can storage 27.

In the apparatus shown in FIG. 2, a polymer melt is extruded through nozzles 3 of annular spinneret 21 to a group of yarns 10. In this process, the group of yarns 10 is formed by individual filaments 4. The group of yarns 10 first enters precooling zone 5. In the precooling zone 5, the filaments 4 of the group of yarns 10 are cooled by a coolant flow of air flow means 32. To this end, the annularly arranged group of yarns 10 is radially biased by a coolant flow from the inside outward. A second coolant flow enters the cooling zone through wall 33 in the radial direction from the outside inward. The filaments 4 of the group of yarns 10 are cooled in precooling zone 5 only to a solidification of their surface layers.

For a further cooling, the group of yarns 10 advances through aftercooling zone 6 of aftercooling shaft 9. In this process, the coolant which is caused to enter precooling zone 5 by the vacuum prevailing in aftercooling zone 6, is sucked into aftercooling zone 6. During its passage through acceleration zone 7, a coolant flow is accelerated to a flow velocity, which is greater than or equal to the speed of the advancing group of yarns 10. This allows to accomplish that the filaments 4 of the group of yarns 10 are assisted in their advance. The withdrawal tensions that are caused by withdrawal means 14 to act upon the group of yarns 10, become effective only with a delay. Consequently, a tension-induced crystallization will occur with a delay. Precooling and aftercooling are adjusted such that the filaments 4 of the group of yarns 10 finally solidify, preferably downstream of acceleration zone 7 or in the lower half thereof. The group of yarns 10 leaves the cooling device through outlet 34. In so doing, the accompanying coolant flow is previously removed by means of the outlet chamber.

Downstream of the cooling device, the roll 24 combines the group of yarns 10 to a tow 23, and the withdrawal means 14 advances it into can storage 27. In can storage 27, the tow 23 is deposited, for example, in a circular can.

The apparatus shown in FIG. 2 is exemplary. Thus, it is possible that for treating the tow, a plurality of draw zones or also heating devices precede the can storage, or that for aftertreating the tow, devices follow, such as, for example, a yarn cutter with a bale press for producing staple fibers. Likewise, the design of the cooling device is exemplary. The method is not limited to generating the coolant flow by a vacuum in the aftercooling zone 6. Essential is that a pressure drop be present between precooling zone 5 and aftercooling zone 6 for generating a coolant flow, which influences the advance of the filaments and, thus, the withdrawal tension. The coolant in use is preferably cooling air.

What is claimed is:

1. A method of melt spinning a group of multifilament yarns from a heated polymer melt comprising the steps of extruding the melt through a plurality of nozzles arranged in a linear arrangement so as to define a plurality of linearly arranged downwardly advancing groups of filaments, and withdrawing the groups of filaments from the nozzles so that the groups of filaments advance a) through a precooling zone wherein the filaments are cooled without significant solidification, and then b) through an aftercooling zone wherein the filaments are further cooled by the action of a coolant flow which is directed into the path of the groups in such a manner that the filaments solidify in a solidification range within the aftercooling zone, with the coolant flow having a predetermined flow velocity for influencing the tension imparted to the filaments.

2. The method of claim 1, wherein the coolant flow is accelerated in an acceleration zone within the aftercooling zone to the predetermined flow velocity, and the solidification range of the filaments extends within the acceleration zone of the aftercooling zone or immediately downstream thereof.

3. The method of claim 2, wherein the flow velocity of the coolant flow upstream of the solidification range of the filaments is substantially equal to or greater than the advancing speed of the filaments.

4. The method of claim 1, wherein the cooling of the filaments within the precooling zone is achieved by a coolant which is controlled such that the position of the solidification range of the filaments within the aftercooling zone is maintained in a predetermined desired range of the aftercooling zone.

5. The method of claim 4, wherein the temperature of the coolant is controlled before entering the precooling zone.

6. The method of claim 5, wherein the volume flow of the coolant is controlled before entering the precooling zone.

7. The method of claim 1, wherein the coolant flow in the aftercooling zone is generated by a suction effect.

8. The method of claim 1, wherein the coolant flow in the aftercooling zone is generated by a blowing effect.

9. The method of claim 1, wherein the coolant flow in the aftercooling zone is generated at least in part from a coolant leaving the precooling zone.

10. The method of claim 1, wherein the coolant flow is generated from a coolant leaving the precooling zone and from a coolant supplied downstream of the precooling zone.

11. The method of claim 1, wherein in the precooling zone a coolant is supplied to the filaments by a suction effect or by a blowing effect.

12. The method of claim 1, wherein each group of filaments is gathered to a yarn which is laid to form a spun-bonded nonwoven yarn after the solidification of the filaments.

13. The method of claim 1, wherein the groups of filaments are gathered to a tow after the solidification of the filaments, and then deposited in a can, or cut and pressed into a bale.

14. The method of claims 1, wherein after the solidification of the filaments the groups of filaments are gathered into a plurality of individual yarns and wound to packages.

15. The method of claim 1, wherein the polymer melt is selected from the group consisting of polyester, polyamide, and polypropylene.

* * * * *